US006893475B1

(12) United States Patent
Ellis et al.

(10) Patent No.: US 6,893,475 B1
(45) Date of Patent: May 17, 2005

(54) LOW SULFUR DISTILLATE FUELS

(75) Inventors: Edward S. Ellis, Basking Ridge, NJ (US); Lynne Gillespie, Oxfordshire (GB); Michele S. Touvelle, Baton Rouge, LA (US); William E. Lewis, Baton Rouge, LA (US); Gordon F. Stuntz, Baton Rouge, LA (US); Lisa I. Yeh, Marlton, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/553,108

(22) Filed: Apr. 20, 2000

Related U.S. Application Data

(63) Continuation-in-part of application No. 09/457,434, filed on Dec. 7, 1999.
(60) Provisional application No. 60/111,346, filed on Dec. 8, 1998.

(51) Int. Cl.[7] ..... C10L 1/08
(52) U.S. Cl. ..... 44/300; 208/15; 585/14
(58) Field of Search ..... 44/300; 208/15; 585/14

(56) References Cited

U.S. PATENT DOCUMENTS 5,389,111 A * 2/1995 Nikanjam et al.
5,389,112 A * 2/1995 Nikanjam et al.
5,792,339 A * 8/1998 Russell
5,976,201 A * 11/1999 Barry et al.
6,004,361 A * 12/1999 Barry et al.
6,150,575 A * 11/2000 Angevine et al.

* cited by examiner

*Primary Examiner*—Jerry D. Johnson
(74) *Attorney, Agent, or Firm*—Gerard J. Hughes; Jeremy J. Kliebert

(57) ABSTRACT

A distillate fuel composition boiling in the range of about 190° C. to 400° C. with a T10 point greater than 205° C., and having a sulfur level of less than about 100 wppm, a total aromatics content of about 15 to 35 wt. %, a polynuclear aromatics content of less than about 3 wt. %, wherein the ratio of total aromatics to polynuclear aromatics is greater than about 11.

23 Claims, 2 Drawing Sheets

LOW SULFUR DISTILLATE FUELS

CROSS REFERENCE TO RELATED APPLICATIONS

This is a Continuation-in-Part of U.S. Ser. No. 09/457,434 filed Dec. 7, 1999, which claims priority from U.S. Provisional Patent Application No. 60/111,346, filed Dec. 8, 1998.

FIELD OF THE INVENTION

The present invention relates to a distillate fuel composition boiling in the range of about 190° C. to 400° C. with a T10 point greater than 205° C., and having a sulfur level of less than about 100 wppm, a total aromatics content of about 15 to 35 wt. %, a polynuclear aromatics content of less than about 3 wt. %, wherein the ratio of total aromatics to polynuclear aromatics is greater than about 11.

BACKGROUND OF THE INVENTION

Diesel fuels are used widely in automotive transport largely due to their high fuel economy. However, one of the problems when such fuels are burned in internal combustion engines is the pollutants in the exhaust gases that are emitted into the environment. For instance, some of the most common pollutants in diesel exhausts are oxides of nitrogen (hereafter abbreviated as "NOx"), particulate matter (including inter alia soot, adsorbed hydrocarbons and sulfates), unburned hydrocarbons, and to a lesser extent carbon monoxide. Also, sulfur dioxide emissions from diesel fuel exhaust gases are becoming increasingly a problem due to their affinity with after-treatment devices designed to reduce NOx and particulate emissions, thereby adversely affecting the functioning efficiency. The oxides of sulfur have been reduced considerably by reducing the sulfur levels in the diesel itself through refining operations such as by hydrodesulfurization. However, further advances are required to meet increasingly demanding worldwide legislation for progressively lower diesel powered vehicle exhaust emissions, especially NOx and particulate matter. An established trade-off exists between the two pollutants, i.e. NOx and particulate matter, whereby an increase in one leads to a decrease in the other, for a given engine and operating conditions.

A typical example of such a scenario is U.S. Pat. No. 5,792,339 in which a diesel oil composition comprising 250–495 wppm sulfur, 5–8.6 wt. % of polynuclear aromatics (PNAs) and 10–23.9 wt. % total aromatics is disclosed. At the same time, further advances in sulfur-sensitive after-treatment technology have led to increasing demand for lower levels of sulfur in diesel fuels.

There are a variety of analytical techniques that have been reported for measurement of total aromatics and polynuclear aromatics. In the discussion and claims that follow, aromatics and PNAs are measured by high performance liquid chromatography (HPLC) as defined by test number IP 391/95, unless otherwise indicated. IP391/95 is described in "IP Standard Methods for Analysis and Testing of Petroleum & Related Products, and British Standard 2000 Parts, 58th edition, February, 1999. This publication is incorporated herein by reference. Boiling range distillation determinations were performed via gas chromatography according to ASTM D2887 providing the temperature at which 10% of the fuel was recovered (T10) and the temperature at which 95% of the fuel was recovered (T95).

Hydrodesulfurization processes that reduce PNAs typically reduce monocyclic aromatics as well as resulting in higher than desired hydrogen consumption. Legislation requiring reduced sulfur content is also anticipated. For example, proposed sulfur limits for distillate fuels to be marketed in the European Union for the year 2005 is 50 wppm or less. Further, the maximum allowable total aromatics level for California Air Resources Board (CARB) reference diesel and Swedish Class I diesel are 10 and 5 vol. %, respectively. Further, the CARB reference fuels allows no more than 1.4 vol. % polyaromatics (PNAs). In Europe, from the year 2000, a limit of polynuclear aromatic content in diesel fuel has been set at 11% by weight but no limit has been set for the total aromatic content (including monocyclic aromatics) of the fuel. Consequently, much work is presently being done in the hydrotreating art because of these proposed regulations.

Hydrotreating, or in the case of sulfur removal, hydrodesulfurization, is well known in the art and typically requires treating the petroleum streams with hydrogen in the presence of a supported catalyst at hydrotreating conditions. The catalyst is usually comprised of a Group VI metal with one or more Group VIII metals as promoters on a refractory support. Hydrotreating catalysts that are particularly suitable for hydrodesulfurization, as well as hydrodenitrogenation, generally contain molybdenum or tungsten as the Group VI metal on alumina support promoted with cobalt, nickel, iron, or a combination thereof as the Group VIII metal. Cobalt promoted molybdenum on alumina catalysts are most widely used when the limiting specifications are hydrodesulfurization, while nickel promoted molybdenum on alumina catalysts are the most widely used for hydrodenitrogenation, partial aromatic saturation, as well as hydrodesulfurization.

Much work is also being done to develop more active catalysts and to improve reaction vessel designs in order to meet the demand for more effective hydroprocessing processes. Various improved hardware configurations have been suggested. One such configuration is a co-current design where feedstock flows downwardly through successive catalyst beds and treat gas, which is typically a hydrogen-containing treat gas, also flows downwardly, co-current with the feedstock. Another configuration is a countercurrent design wherein the feedstock flows downwardly through successive catalyst beds counter to upflowing treat gas, which is typically a hydrogen-containing treat-gas. The downstream catalyst beds, relative to the flow of feed, can contain high performance, but otherwise more sulfur sensitive catalysts because the upflowing treat gas carries away heteroatom components, such as $H_2S$ and $NH_3$, that are deleterious to sulfur and nitrogen sensitive catalysts.

Other process configurations include the use of multiple reaction stages, either in a single reaction vessel, or in separate reaction vessels. More sulfur sensitive catalysts can be used in the downstream stages as the level of heteroatom components becomes successively lower. European Patent Application 93200165.4 teaches such a two-stage hydrotreating process performed in a single reaction vessel.

Distillate fuel compositions are taught that meet some of the low emissions requirements. For example, U.S. Pat. No. 5,389,111 teaches a diesel fuel composition having an aromatics content in the range from about 13 to 20 wt. %, a cetane number from about 54 to 60, which cetane number and aromatics content being within a certain area defined in FIG. 1 of that patent. U.S. Pat. No. 5,389,112 teaches a low emissions diesel fuel composition having an aromatics content in the range of about 14.3 to 19.7 wt. %, a cetane number from about 53.4 to 60.8, which cetane number and aromatics content falls within a certain area of FIG. 1 of their patent.

While distillate fuel compositions exist that produce lower levels of emissions than years past, there is still a need in the art for fuels with ever lower emissions levels that are needed to meet the ever stricter environmental regulations.

It has now been found that by controlling the amount of sulfur, PNAs and total aromatics in the diesel fuel within specific limits, the amount of NOx and particulates emitted from exhausts can be synergistically reduced.

SUMMARY OF THE INVENTION

In accordance with the present invention there is provided a distillate fuel composition boiling in the range of about 190° C. to 400° C. with a T10 point greater than 205° C., and having a sulfur level of less than about 100 wppm, a total aromatics content of about 15 to 35 wt. %, a polynuclear aromatics content of less than about 3 wt. %, wherein the ratio of total aromatics to polynuclear aromatics is greater than about 11.

In a preferred embodiment of the present invention the sulfur level is less than about 50 wppm.

In another preferred embodiment of the present invention the total aromatics content is from about 20 to 35 wt. %.

In still another preferred embodiment of the present invention the ratio of total aromatics to polynuclear aromatics is at least 15.

In yet another embodiment, the invention is a fuel composition comprising a distillate boiling in the range of about 190° C. to 400° C. with a T10 point greater than 205° C., and having a sulfur level of less than about 100 wppm, a total aromatics content of about 15 to 35 wt. %, a polynuclear aromatics content of less than about 3 wt. %, wherein the ratio of total aromatics to polynuclear aromatics is greater than about 11, to which is added at least one of (i) one or more lubricity aid, (ii) one or more viscosity modifier, (iii) one or more antioxidant, (iv) one or more cetane improver, (v) one or more dispersant, (vi) one or more cold flow improver, (vii) one or more metals deactivator, (viii) one or more corrosion inhibitor, (ix) one or more detergent, and (x) one or more distillate or upgraded distillate.

In still another preferred embodiment, the fuel is employed in a compression ignition (e.g. diesel) engine, preferably in order to abate NOx and particulate emissions therefrom. More preferably, the fuel is employed in an automotive diesel engine.

DETAILED DESCRIPTION OF THE INVENTION

Feedstreams suitable for producing the low emissions distillate fuel compositions of this invention are those petroleum based feedstreams boiling in the distillate range and above. Such feedstreams typically have a boiling range from about 190 to about 400° C., preferably from about 200 to about 370° C. These feedstreams typically contain greater than about 3,000 wppm sulfur. Non-limiting examples of such feedstreams include virgin distillates, light cat cycle oils, light coker oils, etc. It is highly desirable for the refiner to upgrade these types of feedstreams by removing as much of the sulfur as possible, as well as to saturate aromatic compounds.

Figure 1:
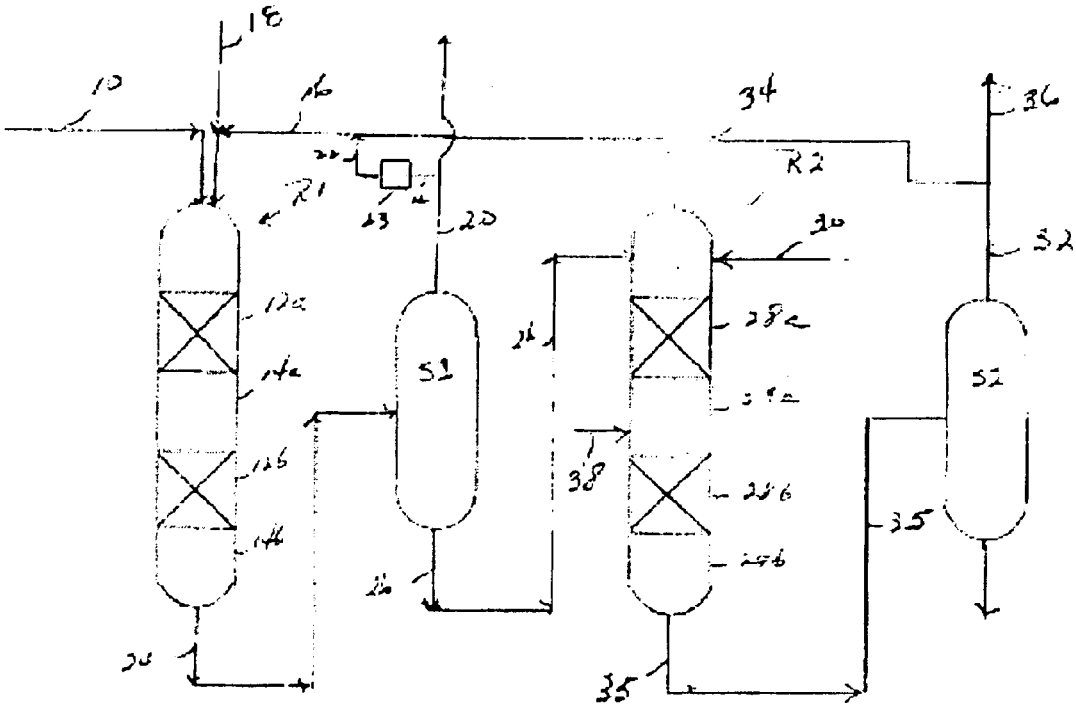
FIG. 1 hereof shows one preferred process scheme used to prepare distillate fuel compositions of present invention. This process scheme includes two co-current hydrodesulfurization stages with once through hydrogen-containing treat gas in the second hydrodesulfurization stage.

It is not critical how the distillate fuel compositions are produced. One preferred process for producing the fuel products of the present invention is illustrated in FIG. 1 hereof. The preferred process uses once-through hydrogen treat gas in a second hydrodesulfurization stage and optionally in a first hydrodesulfurization stage as well. Relatively low amounts of hydrogen are utilized in the second hydrodesulfurization stage in such a way that very low levels of sulfur in the liquid product can be achieved while minimizing the amount of hydrogen consumed via saturation of the aromatics. The first hydrodesulfurization stage will reduce the levels of both sulfur and nitrogen, with sulfur levels being less than about 1,000 wppm, preferably less than about 500 wppm. The second hydrodesulfurization stage will reduce sulfur levels to less than about 100 wppm, preferably to less than about 50 wppm. In the practice of this invention the hydrogen in the treat gas reacts with impurities to convert them to $H_2S$, $NH_3$, and water vapor, which are removed as part of the vapor effluent, and it also saturates olefins and aromatics.

Miscellaneous reaction vessel internals, valves, pumps, thermocouples, and heat transfer devices etc. are not shown for simplicity. FIG. 1 shows hydrodesulfurization reaction vessel R1 which contains reaction zones 12*a* and 12*b*, each of which is comprised of a bed of hydrodesulfurization catalyst. It will be understood that this reaction stage can contain only one reaction zone or two or more reaction zones. It is preferred that the catalyst be in the reactor as a fixed bed, although other types of catalyst arrangements can be used, such as slurry or ebullating beds. Downstream of each reaction zone is a non-reaction zone, 14*a* and 14*b*. The non-reaction zone is typically void of catalyst, that is, it will be an empty section in the vessel with respect to catalyst. Although not shown, there may also be provided a liquid distribution means upstream of each reaction stage or catalyst bed. The type of liquid distribution means is believed not to limit the practice of the present invention, but a tray arrangement is preferred, such as sieve trays, bubble cap trays, or trays with spray nozzles, chimneys, tubes, etc. A vapor-liquid mixing device (not shown) can also be employed in non-reaction zone 14*a* for the purpose of introducing a quench fluid (liquid or vapor) for temperature control.

The feedstream is fed to reaction vessel R1 via line 10 along with a hydrogen-containing treat gas via line 18, which treat gas will typically be from another refinery process unit, such as a naphtha hydrofiner. It is within the scope of this invention that treat gas can also be recycled via lines 20, 22, and 16 from separation zone S1. The term "recycled" when used herein regarding hydrogen treat gas is meant to indicate a stream of hydrogen-containing treat gas separated as a vapor effluent from one stage that passes through a gas compressor 23 to increase its pressure prior to being sent to the inlet of a reaction stage. It should be noted that the compressor will also generally include a scrubber to remove undesirable species such as $H_2S$ from the hydrogen recycle stream. The feedstock and hydrogen-containing treat gas pass, co-currently, through the one or more reaction zones of hydrodesulfurization stage R1 to remove a substantial amount of the heteroatoms, preferably sulfur, from the feedstream. It is preferred that the first hydrodesulfurization stage contain a catalyst comprised of Co—Mo, or Ni—Mo on a refractory support.

The term "hydrodesulfurization" as used herein refers to processes wherein a hydrogen-containing treat gas is used in the presence of a suitable catalyst which is primarily active for the removal of heteroatoms, preferably sulfur, and nitrogen, and for some hydrogenation of aromatics. Suitable hydrodesulfurization catalysts for use in the reaction vessel R1 of the present invention include conventional hydrodesulfurization catalyst such as those that are comprised of at least one Group VIII metal, preferably Fe, Co or Ni, more preferably Co and/or Ni, and most preferably Co; and at least one Group VI metal, preferably Mo or W, more preferably Mo, on a relatively high surface area refractory support material, preferably alumina. Other suitable hydrodesulfurization catalyst supports include refractory oxides such as silica, zeolites, amorphous silica-alumina, and titania-alumina. Additives such as P can also be present. It is within the scope of the present invention that more than one type of hydrodesulfurization catalyst be used in the same reaction vessel and in the same reaction zone. The Group VIII metal is typically present in an amount ranging from about 2 to 20 wt. %, preferably from about 4 to 15%. The Group VI metal will typically be present in an amount ranging from about 5 to 50 wt. %, preferably from about 10 to 40 wt. %, and more preferably from about 20 to 30 wt. %. All metals weight percents are based on the weight of the catalyst. Typical hydrodesulfurization temperatures range from about 200° C. to about 400° C. with a total pressures of about 50 psig to about 3,000 psig, preferably from about 100 psig to about 2,500 psig, and more preferably from about 150 to 500 psig. More preferred hydrogen partial pressures will be from about 50 to 2,000 psig, most preferably from about 75 to 800 psig.

A combined liquid phase/vapor phase product stream exits hydrodesulfurization stage R1 via line 24 and passes to separation zone S1 wherein a liquid phase product stream is separated from a vapor phase product stream. The liquid phase product stream will typically be one that has components boiling in the range from about 190° C. to about 400° C., but will not have an upper boiling range greater than the feedstream. The vapor phase product stream is collected overhead via line 20. The liquid reaction product from separation zone S1 is passed to hydrodesulfurization stage R2 via line 26 and is passed downwardly through the reaction zones 28*a* and 28*b*. Non-reaction zones are represented by 29*a* and 29*b*.

Hydrogen-containing treat gas is introduced into reaction stage R2 via line 30 which may be cascaded or otherwise obtained from a refinery process unit such as a naphtha hydrofiner. Although this figure shows the treat gas flowing co-current with the liquid feedstream, it is also within the scope of this invention that the treat gas can be introduced into the bottom section of reactor R2 and flowed countercurrent to the downward flowing liquid feedstream. It is preferred that the rate of introduction of hydrogen contained in the treat gas be less than or equal to 3 times the chemical hydrogen consumption of this stage, more preferably less than about 2 times, and most preferably less than about 1.5 times. The feedstream and hydrogen-containing treat gas pass, preferably cocurrently, through the one or more reaction zones of hydrodesulfurization stage R2 to remove a substantial amount of remaining sulfur, preferably to a level wherein the feedstream now has less than about 100 wppm sulfur, preferably less than about 50 wppm sulfur, and more preferably less than 10 wppm sulfur. Suitable hydrodesulfurization catalysts for use in the reaction vessel R2 in the present invention include conventional hydrodesulfurization catalyst, such as those previously described for use in R1. Noble metal catalysts may also be employed, preferably the noble metal is selected from Pt and Pd or a combination thereof. Pt, Pd or the combination thereof is typically present in an amount ranging from about 0.5 to 5 wt. %, preferably from about 0.6 to 1 wt. %. Typical hydrodesulfurization temperatures range from about 200° C. to about 400° C. with a total pressures of about 50 psig to about 3,000 psig, preferably from about 100 psig to about 2,500 psig, and more preferably from about 150 to 1,500 psig. More preferred hydrogen partial pressures will be from about 50 to 2,000 psig, most preferably from about 75 to 1,000 psig. In one embodiment, R2 outlet pressure ranges from about 500 to about 1000 psig.

It is within the scope of this invention that second reaction stage R2 can be run in two or more temperature zones and in either cocurrent or countercurrent mode. By two or more temperature zones we mean that reaction stage R2 will contain two or more separate beds of catalyst wherein at least one such bed is operated at a temperature of at least 25° C. lower than the other catalyst beds comprising the reaction stage. It is preferred that the lower temperature zone(s) be operated at a temperature of at least about 50° C. lower than the higher temperature zone(s). It is also preferred that the lower temperature zone be the last downstream zone(s) with respect to the flow of feedstock. It is also within the scope of this invention that the second reaction stage be operated in either co-current or countercurrent mode. By countercurrent mode we mean that the treat gas will flow upwardly, counter to the downflowing feedstock.

The reaction product from second hydrodesulfurization stage R2 is passed via line 35 to a second separation zone S2 wherein a vapor product, containing hydrogen, is preferably recovered overhead via line 32 and may be removed from the process via line 36. When either (i) all hydrogen-containing treat gas introduced into a reactor is consumed therein or (ii) unreacted hydrogen-containing treat gas present in a reactor's vapor phase effluent and is conducted away from the reactor, then the treat gas is referred to as a "once-through" treat gas. Alternatively, all or a portion of the vapor product may be cascaded to hydrodesulfurization stage R1 via lines 34 and 16. The term "cascaded", when used in conjunction with treat gas is meant to indicate a stream of hydrogen-containing treat gas separated as a vapor effluent from one stage that is sent to the inlet of a reaction stage without passing through a gas compressor. That is, the treat gas flows from a downstream reaction stage to an upstream stage that is at the same or lower pressure, and thus there is no need for the gas to be compressed.

FIG. 1 also shows several optional process schemes. For example, line 38 can carry a quench fluid that may be either a liquid or a gas. Hydrogen is a preferred gas quench fluid and kerosene is a preferred liquid quench fluid.

The reaction stages used in the practice of the present invention are operated at suitable temperatures and pressures for the desired reaction. For example, typical hydroprocessing temperatures will range from about 200° C. to about 400° C. at pressures from about 50 psig to about 3,000 psig, preferably 50 to 2,500 psig, and more preferably about 150 to 1,500 psig. Furthermore, reaction stage R2 can be operated in two or more temperature zones wherein the most downstream temperature zone is at least about 25° C., preferably about 35° C., cooler than the upstream temperature zone(s).

For purposes of hydroprocessing and in the context of the present invention, the terms "hydrogen" and "hydrogen-containing treat gas" are synonymous and may be either pure hydrogen or a hydrogen-containing treat gas which is a treat gas stream containing hydrogen in an amount at least sufficient for the intended reaction, plus other gas or gasses (e.g., nitrogen and light hydrocarbons such as methane) which will not adversely interfere with or affect either the reactions or the products. Impurities, such as $H_2S$ and $NH_3$ are undesirable and, if present in significant amounts, will normally be removed from the treat gas, before it is fed into the R1 reactor. The treat gas stream introduced into a reaction stage will preferably contain at least about 50 vol. % hydrogen, more preferably at least about 75 vol. % hydrogen, and most preferably at least 95 vol. % hydrogen. In operations in which unreacted hydrogen in the vapor effluent of any particular stage is used for hydroprocessing in any stage, there must be sufficient hydrogen present in the fresh treat gas introduced into that stage, for the vapor effluent of that stage to contain sufficient hydrogen for the subsequent stage or stages. It is preferred in the practice of the invention, that all or a portion of the hydrogen required for the first stage hydroprocessing be contained in the second stage vapor effluent fed up into the first stage. The first stage vapor effluent will be cooled to condense and recover the hydrotreated and relatively clean, heavier (e.g., $C_4$+) hydrocarbons.

The liquid phase in the reaction vessels used in the present invention will typically be comprised of primarily the higher boiling point components of the feed. The vapor phase will typically be a mixture of hydrogen-containing treat gas, heteroatom impurities like $H_2S$ and $NH_3$, and vaporized lower-boiling components in the fresh feed, as well as light products of hydroprocessing reactions. If the vapor phase effluent still requires further hydroprocessing, it can be passed to a vapor phase reaction stage containing additional hydroprocessing catalyst and subjected to suitable hydroprocessing conditions for further reaction. Alternatively, the hydrocarbons in the vapor phase products can be condensed via cooling of the vapors, with the resulting condensate liquid being recycled to either of the reaction stages, if necessary.

As discussed, the preferred process may be used to form the fuel products of the invention. Such distillate fuel products are characterized as having relatively low sulfur and polynuclear aromatics (PNAs) levels and a relatively high ratio of total aromatics to polynuclear aromatics. Such distillate fuels may be employed in compression-ignition engines such as diesel engines, particularly so-call "lean-burn" diesel engines. Such fuels are compatible with: compression-ignition engine systems such as automotive diesel systems utilizing (i) sulfur-sensitive NOx conversion exhaust catalysts, (ii) engine-exhaust particulate emission reduction technology, including particulate traps, and (iii) combinations of (i) and (ii). Such distillate fuels have moderate levels of total aromatics, reducing the cost of producing cleaner-burning diesel fuel and also reducing $CO_2$ emissions by minimizing the amount of hydrogen consumed in the process.

The preferred fuels may be combined with other distillate or upgraded distillate. As discussed, the products are compatible with effective amounts of fuel additives such as lubricity aids, cetane improvers, and the like. While a major amount of the product is preferably combined with a minor amount of the additive, the fuel additive may be employed to an extent not impairing the performance of the fuel. While the specific amount(s) of any additive employed will vary depending on the use of the product, the amounts may generally range from 0.05 to 2.0 wt % based on the weight of the product and additive(s), although not limited to this range. The additives can be used either singly or in combination as desired.

In one embodiment, the distillate compositions of the present invention contain less than about 100 wppm, preferably less than about 50 wppm, more preferably less than about 10 wppm sulfur. They will also have a total aromatics content from about 15 to 35 wt. %, preferably from about 20 to 35 wt. %, and most preferably from about 25 to 35 wt. %. The PNA content of the distillate product compositions obtained by the practice of the present invention will be less than about 3 wt. %, preferably less than about 2 wt. %, and more preferably less than about 1 wt. %. The aromatics to PNA ratio will be at least about 11, preferably at least about 13, and more preferably at least about 15. Further, the distillate fuels of the present invention have relatively low amounts of low boiling material with a T10 distillation point of at least about 205° C. In one embodiment, the aromatics to PNA ratio will be at least about 11, preferably at least about 13, and more preferably at least about 15. In another embodiment, the aromatics to PNA ratio ranges from 11 to about 50, preferably from 11 to about 30, and more preferably from 11 to about 20.

The term PNA is meant to refer to polynuclear aromatics that are defined as aromatic species having two or more aromatic rings, including alkyl and olefin-substituted derivatives thereof. Naphthalene and phenanthrene are examples of PNAs. The term aromatics is meant to refer species containing one or more aromatic ring, including alkyl and olefin-substituted derivatives thereof. Thus, naphthalene and phenanthrene are also considered aromatics along with benzene, toluene and tetrahydronaphthalene. It is desirable to reduce PNA content of the liquid product stream since PNAs contribute significantly to emissions in diesel engines. However, it is also desirable to minimize hydrogen consumption for economic reasons and to minimize $CO_2$ emissions associated with the manufacture of hydrogen via steam reforming. Thus, the current invention achieves both of these by obtaining a high aromatics to PNA ratio in the liquid product.

The following examples are presented to illustrate the present invention and not to be taken as limiting the scope of the invention in any way.

EXAMPLES 1–5

A virgin distillate feed containing from about 10,000 to 12,000 wppm sulfur was processed in a commercial hydrodesulfurization unit (first hydrodesulfurization stage) using a reactor containing both conventional commercial $NiMo/Al_2O_3$ (Akzo-Nobel KF842/840) and $CoMo/Al_2O_3$ (Akzo-Nobel KF-752) catalyst under the following typical conditions: 300–350 psig; 150–180 psig outlet $H_2$; 75% $H_2$ treat gas; 500–700 SCF/B treat gas rate; 0.3–0.45 LHSV; 330–350 C. The liquid product stream from this first hydrodesulfurization stage was used as feedstream to the second hydrodesulfurization stage, which product stream is described under the feed properties heading in Table 1 below. The process conditions for this second hydrodesulfurization stage are also shown in the table below. A commercial NiMo catalyst (Criterion C-411 containing 2.6 wt % Ni and 14.3 wt % Mo) was used in all of the runs.

Examples 1–5 in Table 1 demonstrate that products with less than 100 wppm sulfur can be produced wherein the rate of introduction of hydrogen in the treat gas in the second reaction stage is less than or equal to three times the chemical hydrogen consumption. Examples 1–5 also demonstrate that products with a total aromatics content between 15 and 35 wt % can be produced with total aromatics/PNA ratios of greater than 11.

TABLE 1

| | Example 1 | Example 2 | Example 3 | Example 4 | Example 5 |
|---|---|---|---|---|---|
| Feed properties to second stage | | | | | |
| S, wppm | 340 | 340 | 99 | 266 | 375 |
| N, wppm | 75 | 75 | 52 | 45 | 101 |
| API | 35.7 | 35.6 | 35.5 | 37.6 | 361 |
| T10, ° C. | 238 | 237 | 240 | 210 | 239 |
| T95, C | 367 | 367 | 374 | 363 | 366 |
| Total aromatics, wt % (HPLC IP 391/95) | 26.51 | 25.99 | 27.06 | 25.26 | 24.07 |
| PNA, wt % (HPLC IP 391/95) | 6.3 | 6.18 | 7.84 | 7.47 | 5.89 |
| H content, wt % | 13.47 | 13.51 | 13.35 | 13.52 | 13.55 |
| Product properties from second stage | | | | | |
| S, wppm | 32.5 | 34.5 | 18.6 | 1.4 | 61 |
| API | 36.7 | 36.7 | 36 | 39.1 | 37.2 |
| T10° C. | 235 | 235 | 238 | 207 | 236 |
| T95° C. | 366 | 365 | 373 | 364 | 365 |
| Total aromatics, wt % (HPLC IP 391/95) | 23.09 | 21.66 | 25.36 | 16.52 | 23.12 |
| PNA, wt % (HPLC IP 391/95) | 2.02 | 1.39 | 1.94 | 1.21 | 1.74 |
| Total aromatics/PNA | 11.43 | 15.58 | 13.07 | 14.24 | 13.28 |
| $H_2$ consumption, SCF/B | 162 | 196 | 175 | 263 | 220 |
| Process conditions for second stage | | | | | |
| T, C | 332 | 332 | 328 | 329 | 337 |
| Pressure, psig | 800 | 800 | 800 | 790 | 800 |
| LHSV | 1.1 | 1.1 | 1.3 | 0.58 | 1.1 |
| Treat gas rate (100% $H_2$), SCF/B | 490 | 480 | 520 | 555 | 530 |
| Treat gas rate/$H_2$ consumption for second stage | 3.0 | 2.4 | 3.0 | 2.3 | 2.4 |

Comparative Examples A–F in Table 2 below are all fuel compositions containing less than 100 ppm sulfur. Comparative examples A–F describe fuels that have total armatics levels greater than 15 wt %. All of them have a ratio of total aromatics to PNAs less than about 10, which is outside the range of the fuel composition of the present invention.

TABLE 2

| | Comparative Example A | Comparative Example B | Comparative Example C | Comparative Example D | Comparative Example E | Comparative Example F |
|---|---|---|---|---|---|---|
| Reference | Executive Order G-714-007 Of the Calif. Air Resources Board | Executive Order G-714-008 Of the Calif. Air Resources Board | As described in Tosco US 5792339 | US 5389111 and US 5389112 | US 5389111 and US 5389112 | US 5389111 and US 5389112 |
| Product properties | | | | | | |
| S, wppm | 33 | 42 | <5 | 44 | 54 | 54 |
| Total aromatics, | 21.7 | 24.7 | | | | |

TABLE 2-continued

| | Comparative Example A | Comparative Example B | Comparative Example C | Comparative Example D | Comparative Example E | Comparative Example F |
|---|---|---|---|---|---|---|
| vol % (D1319-84; FIA) | | | | | | |
| PNA, wt % (D 2425-83; mid-distillate MS) | 4.6 | 4.0 | 1.9 | 2.56 | 2.22 | 2.62 |
| Total aromatics, wt % (D 5186; SFC) | | | 19.4 | 16 | 19 | 19 |
| Total aromatics/PNA | 4.72 | 6.18 | 10.2 | 6.25 | 8.6 | 7.3 |

The designations "FIA", "MS", and "SFC" are well known in the art as analytical techniques. For example, "FIA" stands for fluorescence indicator analysis, "MS" stands for mass spectrophotometry; and "SFC" stands for supercritical fluid chromatography. Table 3 provides additional comparative examples of distillate fuels that fall outside the range of this invention. These data were obtained from the following publications.

3-1 X. Li et al. "Comparison of the Exhaust Emissions of Diesel Fuels Derived From Oil Sands and Conventional Crude Oil", SAE Technical Paper Series 982487, Oct. 19–22, 1998.

3-2 B. Martin et al., Influence of Future Fuel Formulations on Diesel Engine Emissions—A Joint European Study", SAE Technical Paper Series 972966, Oct. 13–16, 1997.

3-3 A. Gerini et al. "Automotive Direct Injection Diesel Engine Sensitivity to Diesel Fuel Characteristics", SAE Technical Paper Series 972963, Oct. 13–16, 1997.

3-4 T. W. Ryan III et al., "Diesel Fuel Composition Effects on Ignition and Emissions", SAE Technical Paper Series 932735, Oct. 18–21, 1993

3-5 M. A. Gonzalez et al., "A Low Emission Diesel Fuel: Hydrocracking Production, Characterization and Engine Evaluations", SAE Technical Paper Series 932731, Oct. 18–21, 1993

3-6 C. I. McCarthy, "Diesel Fuel Property Effects on Exhaust Emissions from a Heavy Duty Diesel Engine that Meets 1994 Emission Requirements", SAE Technical Paper Series 922267, Oct. 19–22, 1992

3-7 W. W. Lange, "The Effect of Fuel Properties on Particulates Emissions in Heavy Duty Truck Engines Under Transient Operating Conditions", SAE Technical Paper Series 9212425, Oct. 7–10, 1991

3-8 C. Beatrice et al., "Potentiality of Oxygenated Synthetic Fuel and Reformulated Fuel on Emissions from a Modern DI Diesel Engine", SAE Technical Paper Series 1999–01–3595, Oct. 25–28, 1999

3-9 N. Mann et al., "Fuel Effects on The Low Temperature Performance of Two Generations of Mercedes-Benz Heavy-Duty Diesel Engines", SAE Technical Paper Series 1999-01-3594, Oct. 25–28, 1999

3-10 D. A. Kouremenos et al., "Experimental Investigation of the Effect of Fuel Composition on the Formation of Pollutants in Direct Injection Diesel Engines", SAE Technical Paper Series 1999-01-0189, Mar. 1–4, 1999

3-11 C. Bertoli et al., "The Influence of Fuel Composition on Particuate Emissions of DI Diesel Engines", SAE Technical Paper Series 932733, Oct. 18–21, 1993

Data reported for the wt. % total aromatics content and PNAs are shown along with the calculated ratio of wt % aromatics/wt % PNAs. The analytical test method for measurement of aromatics and PNAs is also indicated along with sulfur content and the T10boiling point. Fuels #1–127 all have an aromatics/PNA ratio less than 11. Fuels #128–151 have a total aromatics content less than 15 wt %. Fuels #152 and 153 have sulfur contents over 100 wppm. Fuels #154–158 have T10 boiling points less than 205° C. Thus, all of the fuels shown in Table 3 fall outside the range of the fuels of the present invention.

TABLE 3

| Fuel# | Pub.# | Fuel Ref. | T10° C. | Aromatics, wt % | PNAs, wt % | Arom./PNA | Anal. Test | S. wppm |
|---|---|---|---|---|---|---|---|---|
| 1 | 3-4 | LSLCO7 | 343.3 | 31.9 | 29.6 | 1.1 | UV | 1100 |
| 2 | 3-4 | LCO5 | 286.7 | 42.7 | 39.4 | 1.1 | UV | 3200 |
| 3 | 3-4 | LCO4 | 268.3 | 60.5 | 55.5 | 1.1 | UV | 4100 |
| 4 | 3-4 | LCO3 | 250.6 | 57.2 | 50.4 | 1.1 | UV | 4500 |
| 5 | 3-4 | LCO6 | 306.1 | 36.4 | 31.5 | 1.2 | UV | 5700 |
| 6 | 3-4 | LCO0 | 246.7 | 43.7 | 37.4 | 1.2 | UV | 2600 |
| 7 | 3-4 | LCO7 | 339.4 | 37.8 | 31.4 | 1.2 | UV | 18500 |
| 8 | 3-4 | LCO2 | 230.6 | 55.2 | 40.8 | 1.4 | UV | 3500 |
| 9 | 3-7 | DD9 | 218.0 | 34.33 | 24.9 | 1.4 | HPLC IP391 | 500 |
| 10 | 3-4 | LSLCO6 | 312.8 | 32.8 | 23.1 | 1.4 | UV | 400 |
| 11 | 3-11 | TAC10 | 213.0 | 13.7 | 9.6 | 1.4 | Mass Spec. | 1050 |
| 12 | 3-4 | SRD3 | 252.2 | 13.3 | 8.9 | 1.5 | UV | 200 |
| 13 | 3-4 | SRD2 | 240.6 | 13.5 | 9 | 1.5 | UV | 100 |
| 14 | 3-4 | SRD7 | 325.0 | 9.3 | 6.2 | 1.5 | UV | 1200 |
| 15 | 3-4 | SRD4 | 267.8 | 12.5 | 8.2 | 1.5 | UV | 300 |
| 16 | 3-4 | LSLCO5 | 283.9 | 34.1 | 22.3 | 1.5 | UV | 100 |
| 17 | 3-4 | SRD5 | 284.4 | 10.9 | 6.9 | 1.6 | UV | 400 |
| 18 | 3-4 | SRD6 | 303.3 | 8.7 | 5.5 | 1.6 | UV | 700 |

TABLE 3-continued

| Fuel# | Pub.# | Fuel Ref. | T10° C. | Aromatics, wt % | PNAs, wt % | Arom./PNA | Anal. Test | S. wppm |
|---|---|---|---|---|---|---|---|---|
| 19 | 3-4 | LCGO7 | 317.2 | 15.2 | 9.6 | 1.6 | UV | 13300 |
| 20 | 3-4 | SRD0 | 241.1 | 11.4 | 7.1 | 1.6 | UV | 500 |
| 21 | 3-4 | LCGO6 | 296.1 | 14.7 | 8.5 | 1.7 | UV | 13200 |
| 22 | 3-4 | LCGO5 | 276.7 | 15.1 | 8.5 | 1.8 | UV | 14800 |
| 23 | 3-7 | DD10 | 214.0 | 8.96 | 5.02 | 1.8 | HPLC IP391 | 400 |
| 24 | 3-4 | LSLCO4 | 261.7 | 36.8 | 20.2 | 1.8 | UV | 0 |
| 25 | 3-4 | LSLCO0 | 222.2 | 35.8 | 19.2 | 1.9 | UV | 300 |
| 26 | 3-11 | DAC20 | 210.0 | 20.6 | 10.8 | 1.9 | Mass Spec. | 2320 |
| 27 | 3-1 | F | 189.0 | 23.5 | 12.2 | 1.9 | SFC | 299 |
| 28 | 3-4 | LCGO4 | 252.2 | 14.4 | 7.3 | 2.0 | UV | 13600 |
| 29 | 3-11 | DAC10 | 210.0 | 14.8 | 7 | 2.1 | Mass Spec. | 1200 |
| 30 | 3-4 | LCGO1 | 223.9 | 15.7 | 7.3 | 2.2 | UV | 14100 |
| 31 | 3-11 | TAC5 | 212.0 | 7.5 | 3.4 | 2.2 | Mass Spec. | 542 |
| 32 | 3-3 | G1 | | 22.1 | 9.7 | 2.3 | Unreported | ca. 500 |
| 33 | 3-3 | G6 | | 31.7 | 13.8 | 2.3 | Unreported | ca. 500 |
| 34 | 3-4 | LSLCO3 | 244.4 | 35.8 | 15.4 | 2.3 | UV | 0 |
| 35 | 3-7 | DD5 | 220.0 | 33.23 | 13.79 | 2.4 | HPLC IP391 | 1900 |
| 36 | 3-7 | DD4 | 220.0 | 33.87 | 14 | 2.4 | HPLC IP391 | 1900 |
| 37 | 3-2 | J4 | 206.0 | 24.7 | 10 | 2.5 | Unreported | 39 |
| 38 | 3-5 | A | 233.0 | 37.5 | 15.1 | 2.5 | HPLC IP391 | 2815 |
| 39 | 3-1 | A | 183.0 | 10.8 | 4.3 | 2.5 | SFC | 466 |
| 40 | 3-7 | DD11 | 225.0 | 30.14 | 11.86 | 2.5 | HPLC IP391 | 2900 |
| 41 | 3-4 | LCGO3 | 230.0 | 13.8 | 5.2 | 2.7 | UV | 10800 |
| 42 | 3-4 | LCO1 | 195.6 | 42.5 | 15.8 | 2.7 | UV | 1600 |
| 43 | 3-10 | N5 | | 26.5 | 9.8 | 2.7 | Unreported | ca. 5000 |
| 44 | 3-4 | LSLCGO6 | 314.4 | 11.4 | 4.2 | 2.7 | UV | 500 |
| 45 | 3-11 | LSC | 200.0 | 16.9 | 6.2 | 2.7 | Mass Spec. | 1300 |
| 46 | 3-4 | SRD1 | 170.0 | 12.3 | 4.5 | 2.7 | UV | 100 |
| 47 | 3-4 | LSLCO2 | 228.9 | 35.4 | 12.5 | 2.8 | UV | 0 |
| 48 | 3-11 | HSC | 221.0 | 22.1 | 7.6 | 2.9 | Mass Spec. | 9420 |
| 49 | 3-1 | Ref2 | 198.9 | 26.6 | 8.8 | 3.0 | HPLC | 351 |
| 50 | 3-9 | Fuel G | 214.0 | 33.9 | 11 | 3.1 | HPLC IP391 | 1000 |
| 51 | 3-9 | Fuel G1 | 214.0 | 33.9 | 11 | 3.1 | HPLC IP391 | 1000 |
| 52 | 3-9 | Fuel H1 | 214.0 | 33.9 | 11 | 3.1 | HPLC IP391 | 1000 |
| 53 | 3-9 | Fuel H | 199.0 | 24.4 | 7.9 | 3.1 | HPLC IP391 | 1000 |
| 54 | 3-9 | CS ADO 1 | 230.0 | 32.2 | 10.3 | 3.1 | HPLC IP391 | 380 |
| 55 | 3-3 | G5 | | 36.6 | 11.7 | 3.1 | Unreported | ca. 500 |
| 56 | 3-4 | LSLCGO5 | 266.7 | 11.2 | 3.5 | 3.2 | UV | 400 |
| 57 | 3-9 | Fuel E | 215.0 | 34.6 | 10 | 3.5 | HPLC IP391 | 800 |
| 58 | 3-4 | LALCO7 | 318.9 | 1.4 | 0.4 | 3.5 | UV | 0 |
| 59 | 3-2 | J5 | 206.0 | 17 | 4.7 | 3.6 | Unreported | 35 |
| 60 | 3-1 | C | 185.0 | 24.5 | 6.7 | 3.7 | SFC | 460 |
| 61 | 3-9 | Fuel F | 199.0 | 30.7 | 8.3 | 3.7 | HPLC IP391 | 800 |
| 62 | 3-9 | Fuel F1 | 199.0 | 30.7 | 8.3 | 3.7 | HPLC IP391 | 800 |
| 63 | 3-7 | DD12 | 236.0 | 25.93 | 6.95 | 3.7 | HPLC IP391 | 1700 |
| 64 | 3-4 | LSLCGO4 | 245.0 | 11 | 2.8 | 3.9 | UV | 200 |
| 65 | 3-11 | HDS | 217.0 | 24.2 | 6.1 | 4.0 | Mass Spec. | 445 |
| 66 | 3-9 | Ref | 207.0 | 25.8 | 5.7 | 4.5 | HPLC IP391 | 440 |
| 67 | 3-4 | LSLCGO0 | 219.4 | 10.5 | 2.3 | 4.6 | UV | 400 |
| 68 | 3-9 | Fuel A | 214.0 | 30.2 | 6.6 | 4.6 | HPLC IP391 | 600 |
| 69 | 3-9 | Fuel C | 216.0 | 28.5 | 6.2 | 4.6 | HPLC IP391 | 700 |
| 70 | 3-10 | N6 | | 25 | 5 | 5.0 | Unreported | ca. 5000 |
| 71 | 3-4 | LALCO6 | 286.1 | 2.5 | 0.5 | 5.0 | UV | 0 |
| 72 | 3-4 | LSLCO1 | 187.8 | 29.1 | 5.8 | 5.0 | UV | 100 |
| 73 | 3-10 | N4 | | 25.2 | 5 | 5.0 | Unreported | ca. 5000 |
| 74 | 3-1 | C10B | 207.5 | 10.2 | 2 | 5.1 | HPLC | 131 |
| 75 | 3-4 | LCGO2 | 201.7 | 11.4 | 2.2 | 5.2 | UV | 11600 |
| 76 | 3-1 | E | 183.0 | 25.2 | 4.8 | 5.3 | SFC | 374 |
| 77 | 3-1 | C30A | 198.5 | 29.6 | 5.6 | 5.3 | HPLC | 270 |
| 78 | 3-9 | Fuel B | 197.0 | 26.2 | 4.9 | 5.3 | HPLC IP391 | 500 |
| 79 | 3-10 | N3 | | 24.9 | 4.6 | 5.4 | Unreported | ca. 5000 |
| 80 | 3-9 | Fuel D | 196.0 | 25.2 | 4.6 | 5.5 | HPLC IP391 | 700 |
| 81 | 3-4 | LALCGO7 | 312.8 | 2.2 | 0.4 | 5.5 | UV | 0 |
| 82 | 3-4 | LASRD7 | 323.9 | 1.1 | 0.2 | 5.5 | UV | 0 |
| 83 | 3-10 | N7 | | 26.5 | 4.8 | 5.5 | Unreported | ca. 5000 |
| 84 | 3-3 | G7 | | 8.4 | 1.5 | 5.6 | Unreported | ca. 500 |
| 85 | 3-4 | LSLCGO3 | 222.2 | 10.2 | 1.8 | 5.7 | UV | 100 |
| 86 | 3-2 | J11 | 224.0 | 16.5 | 2.9 | 5.7 | Unreported | 23 |
| 87 | 3-2 | J12 | 231.0 | 13.2 | 2.3 | 5.7 | Unreported | 37 |
| 88 | 3-10 | N2 | | 25.5 | 4.4 | 5.8 | Unreported | ca. 5000 |
| 89 | 3-2 | J10 | 213.0 | 21.6 | 3.6 | 6.0 | Unreported | 75 |
| 90 | 3-1 | S10B | 183.0 | 12 | 2 | 6.0 | HPLC | 2 |
| 91 | 3-6 | D | 233.0 | 38.4 | 8.6 | 6.1 | MS2425 | 510 |
| 92 | 3-6 | E | 233.0 | 38.4 | 8.6 | 6.1 | MS2425 | 510 |
| 93 | 3-6 | F | 233.0 | 38.4 | 8.6 | 6.1 | MS2425 | 510 |
| 94 | 3-7 | DD8 | 196.0 | 38.68 | 6.35 | 6.1 | HPLC IP391 | 300 |

TABLE 3-continued

| Fuel# | Pub.# | Fuel Ref. | T10° C. | Aromatics, wt % | PNAs, wt % | Arom./PNA | Anal. Test | S. wppm |
|---|---|---|---|---|---|---|---|---|
| 95 | 3-11 | TNC5 | 213.0 | 6.1 | 1 | 6.1 | Mass Spec. | 2 |
| 96 | 3-9 | CS ADO 2 | 206.0 | 20.8 | 3.4 | 6.1 | HPLC IP391 | 130 |
| 97 | 3-9 | CS ADO 3 | 206.0 | 20.8 | 3.4 | 6.1 | HPLC IP391 | 140 |
| 98 | 3-1 | C20A | 191.0 | 20 | 3.2 | 6.3 | HPLC | 31 |
| 99 | 3-3 | G2 | | 18 | 2.8 | 6.4 | Unreported | ca. 500 |
| 100 | 3-11 | HCK | 179.0 | 6.7 | 1.04 | 6.4 | Mass Spec. | 50 |
| 101 | 3-2 | J1 | 216.0 | 27 | 4.1 | 6.6 | Unreported | 100 |
| 102 | 3-4 | LALCGO6 | 286.7 | 2.7 | 0.4 | 6.8 | UV | 0 |
| 103 | 3-1 | Ref1 | 205.6 | 25.9 | 3.6 | 7.2 | HPLC | 287 |
| 104 | 3-4 | LALCO5 | 267.8 | 2.9 | 0.4 | 7.3 | UV | 0 |
| 105 | 3-4 | LASRD6 | 297.2 | 1.5 | 0.2 | 7.5 | UV | 0 |
| 106 | 3-4 | LALCO4 | 247.2 | 3.9 | 0.5 | 7.8 | UV | 0 |
| 107 | 3-10 | N1 | | 27.4 | 3.5 | 7.8 | Unreported | ca. 5000 |
| 108 | 3-6 | I | 222.0 | 27.9 | 4.2 | 8.0 | MS 2425 | 420 |
| 109 | 3-11 | HDT40 | 214.0 | 16.9 | 2.1 | 8.0 | Mass Spec. | 2 |
| 110 | 3-4 | LALCGO5 | 264.4 | 3.3 | 0.4 | 8.3 | UV | 0 |
| 111 | 3-1 | C20B | 194.0 | 19.8 | 2.4 | 8.3 | HPLC | 134 |
| 112 | 3-5 | H(cut) | 234.1 | 8.5 | 1 | 8.5 | HPLC IP391 | 10 |
| 113 | 3-4 | LALCGO4 | 245.6 | 3.4 | 0.4 | 8.5 | UV | 0 |
| 114 | 3-4 | LASRD5 | 276.7 | 2.6 | 0.3 | 8.7 | UV | 0 |
| 115 | 3-4 | LALCO0 | 215.0 | 3.5 | 0.4 | 8.8 | UV | 0 |
| 116 | 3-6 | J | 228.0 | 25.6 | 3.6 | 8.9 | MS 2425 | 300 |
| 117 | 3-4 | LASRD4 | 250.0 | 3.6 | 0.4 | 9.0 | UV | 0 |
| 118 | 3-2 | J2 | 234.0 | 3.6 | 0.4 | 9.0 | Unreported | 1 |
| 119 | 3-1 | C30B | 198.5 | 30.2 | 3.3 | 9.2 | HPLC | 202 |
| 120 | 3-3 | G4 | | 15.7 | 1.7 | 9.2 | Unreported | ca. 500 |
| 121 | 3-3 | G3 | | 8.5 | 0.9 | 9.4 | Unreported | ca. 500 |
| 122 | 3-5 | H | 239.4 | 10.4 | 1.1 | 9.5 | HPLC IP391 | 10 |
| 123 | 3-8 | FSG | 218.5 | 14.8 | 1.5 | 9.9 | Unreported | 18 |
| 124 | 3-4 | LSLCGO2 | 203.9 | 10.9 | 1.1 | 9.9 | UV | 100 |
| 125 | 3-6 | A | 200.0 | 20 | 3.4 | 10.0 | MS 2425 | 410 |
| 126 | 3-6 | B | 200.0 | 20 | 3.4 | 10.0 | MS 2425 | 410 |
| 127 | 3-4 | LALCO3 | 230.0 | 4.1 | 0.4 | 10.3 | UV | 0 |
| 128 | 3-2 | J7 | 192.0 | 1.8 | 0.05 | 36.0 | Unreported | 1 |
| 129 | 3-4 | LALCGO0 | 224.4 | 3.3 | 0.3 | 11.0 | UV | 0 |
| 130 | 3-4 | LASRD0 | 227.8 | 3.3 | 0.3 | 11.0 | UV | 0 |
| 131 | 3-4 | LALCGO3 | 225.0 | 3.5 | 0.3 | 11.7 | UV | 0 |
| 132 | 3-4 | LALCO2 | 211.1 | 3.6 | 0.2 | 18.0 | UV | 0 |
| 133 | 3-4 | LALCGO2 | 206.7 | 3.9 | 0.2 | 19.5 | UV | 0 |
| 134 | 3-11 | DNC20 | 206.0 | 4.1 | 0.2 | 20.5 | Mass Spec. | 1 |
| 135 | 3-1 | Ref3 | 244.8 | 4.2 | 0 | N.A. | HPLC | 9 |
| 136 | 3-4 | LALCGO1 | 190.0 | 4.5 | 0.2 | 22.5 | UV | 0 |
| 137 | 3-11 | DNC10 | 208.0 | 4.6 | 0.4 | 11.5 | Mass Spec. | 1 |
| 138 | 3-4 | LASRD3 | 226.7 | 5 | 0.4 | 12.5 | UV | 0 |
| 139 | 3-11 | TNC | 213.0 | 5 | 0.1 | 50.0 | Mass Spec. | 1 |
| 140 | 3-6 | L | 229.0 | 5.2 | 1.3 | 44.0 | MS 2425 | 490 |
| 141 | 3-4 | LALCO1 | 183.3 | 5.6 | 0.2 | 28.0 | UV | 0 |
| 142 | 3-4 | LASRD2 | 196.7 | 5.8 | 0.3 | 19.3 | UV | 0 |
| 143 | 3-11 | HDT70 | 211.0 | 6.6 | 0.5 | 13.2 | Mass Spec. | 1 |
| 144 | 3-4 | LASRD1 | 116.1 | 7.7 | 0.1 | 77.0 | UV | 0 |
| 145 | 3-5 | Ref.K541 | 216.7 | 9.8 | 0.8 | 12.3 | HPLC IP391 | 390 |
| 146 | 3-4 | LSLCGO1 | 182.2 | 10 | 0.6 | 16.7 | UV | 100 |
| 147 | 3-1 | C10A | 200.0 | 10.4 | 0.7 | 14.9 | HPLC | 8 |
| 148 | 3-6 | C | 198.0 | 11.7 | 1.6 | 16.9 | MS 2425 | 110 |
| 149 | 3-1 | S10A | 175.5 | 11.7 | 0.5 | 23.4 | HPLC | 13 |
| 150 | 3-6 | G | 172.0 | 14.2 | 1.3 | 12.1 | MS 2425 | 20 |
| 151 | 3-6 | H | 172.0 | 14.2 | 1.3 | 12.1 | MS 2425 | 20 |
| 152 | 3-10 | N0 | | 25.7 | 1.1 | 23.4 | Unreported | ca. 5000 |
| 153 | 3-6 | K | 236.0 | 17.1 | 4.4 | 13.8 | MS 2425 | 110 |
| 154 | 3-1 | S30An5 | 185.0 | 32.1 | 2.5 | 12.8 | HPLC | 85 |
| 155 | 3-1 | S20Bn1 | 179.0 | 22.8 | 1.9 | 12.0 | HPLC | 31 |
| 156 | 3-1 | S20A | 181.0 | 20 | 1 | 20.0 | HPLC | 29 |
| 157 | 3-9 | CS ADO 4 | 202.0 | 19.8 | 1.4 | 14.1 | HPLC IP391 | 16 |
| 158 | 3-1 | S30Bn1 | 186.5 | 31.3 | 2.5 | 12.5 | HPLC | 3 |

Figure 2:
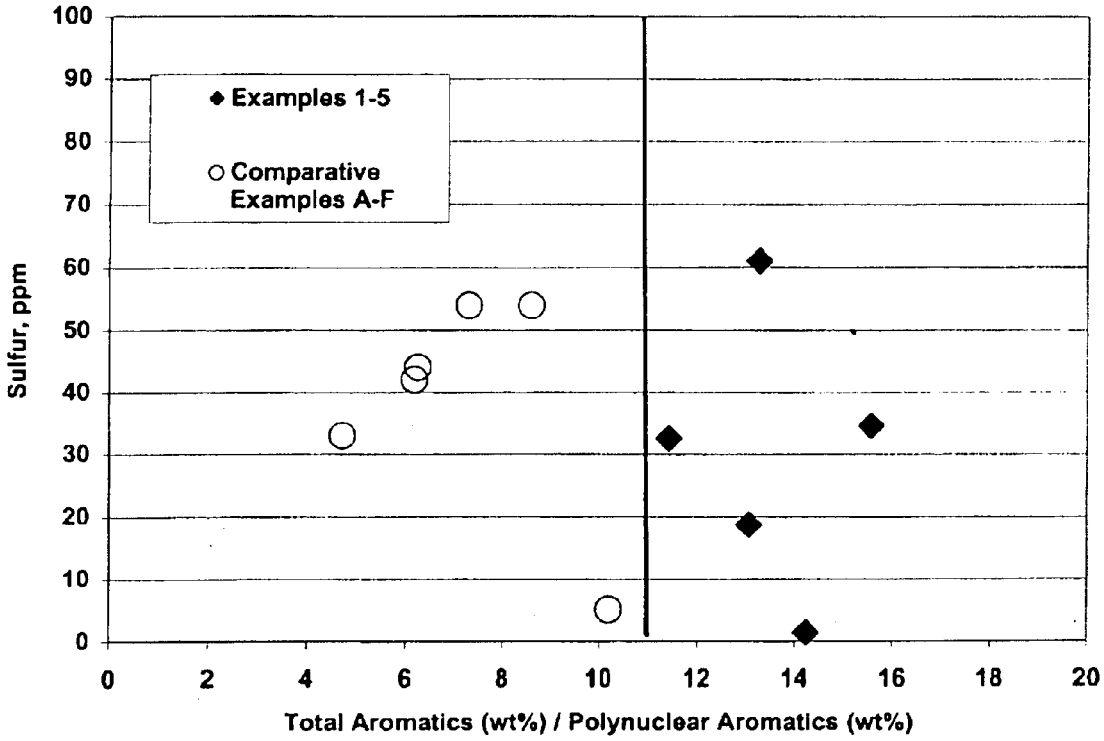
FIG. 2 hereof shows a plot that defines the composition of distillate products of the present invention where the sulfur content is less than 100 ppm and the ratio of total aromatics to polynuclear aromatics is greater than about 11.

The area to the right of the vertical line in the FIG. 2 hereof defines the preferred products of this invention. While FIG. 2's abscissa is truncated at 20, it should be understood that the product total aromatics/PNA ratio of the preferred products may exceed 20. In addition to the total aromatics (15–35 wt %) and total aromatics/PNA criteria, the preferred products have S levels less than about 100 wppm and a T10 point of >205° C.

By using the diesel fuel compositions of the present invention in a compression ignition engine, the level of the pollutants NOx and particulate matter is reduced. Accordingly, emissions levels of NOx below 0.5 g/Km and particulate matter below 0.05 g/Km may be attained. These values/levels are significantly lower than that for comparable fuels in which the aromatic content split (i.e., the total aromatics to PNA ratio) falls outside the ranges of the present invention as shown in the examples below.

The present invention is further illustrated with reference to the Examples set forth in Table 4 below.

The following data was generated from two distillate fuels. The first one, Example 6, was prepared in a commercial hydrodesulfurization unit from a virgin distillate feed using a conventional $CoMo/Al_2O_3$ catalyst and represents a typical commercial diesel fuel composition. The second one, Example 7, is a composition according to the present invention, as set forth in Table 1. The properties of these two fuels are show in Table 4 below.

TABLE 4

| | Example 6 | Example 7 |
|---|---|---|
| Sulfur (wppm) | 400 | 61 |
| Mono-aromatics (% wt) | 19.26 | 21.38 |
| Polynuclear aromatics (% wt) | 4.84 | 1.74 |
| Total aromatics (% wt) | 24.10 | 23.12 |
| Aromatics/PNAs | 5.0 | 13.3 |
| Density (kg/m$^3$) | 844.1 | 838.8 |
| Cetane No. | 55.8 | 56.5 |
| $T_{95}$ (° C.) | 337.0 | 335.1 |

These fuels were run in a fleet of 3 light-duty diesel vehicles encompassing traditional and modern technology, i.e., one with distributor pump technology, one with common rail fuel injection technology and one with electronic unit injector technology. Each fuel was tested three times in each vehicle (a total of nine tests per fuel) comprising a cold-start legislated European type certification drive cycle (ECE+EUDC) in order to determine average particulate emissions and average NOx emissions for both fuels. These average values were then compared to the predicted values for both fuels in accordance with the Europe Pogramme on Emissions, Fuel and Engine (EPEFE) technologies and the AutoOil equation for the effect of sulfur to determine to expected performance of the fuels now used. The EPEFE program is based on an established set of equations from testing of 11 diesel fuels in 19 vehicles to predict the emissions performance of a fleet of vehicles based upon the fuel parameters: cetane No., density and polycyclic aromatic content. On the basis of the differences in fuel parameters between Example 6 and Example 7, the EPEFE calculations would lead one to expect lower particulate matter and NOx emissions for the fuel of Example 7.

The results shown in Table 5 below show the average difference between the predicted reduction in emissions obtained from the EPEFE calculations and the observed reduction in average emissions for the fuel of Example 7 vs. the fuel of Example 6. Surprisingly, the data indicate that the reduction in NOx and particulate matter emissions achieved using the fuel compositions of the present invention (Example 7) were substantially greater than that predicted for any of the 19 vehicles used in the EPEFE program as well as being significantly lower than the EPEPE fleet average. In table 5, as in table 7 below, negative percentages indicate an emissions performance improvement.

Table 5. EPEFE/AutoOil predictions and actual fleet measurements for Example 7 emissions vs. Example 6 emission(%).

| EPEFE Vehicle | PM | NOx |
|---|---|---|
| 1 | −5.8 | −0.1 |
| 2 | −7.5 | −0.9 |
| 3 | | 0.0 |
| 4 | −5.6 | |
| 5 | −3.3 | −1.7 |
| 6 | | −2.5 |
| 7 | −4.9 | −1.8 |
| 8 | −6.7 | −1.7 |
| 9 | −2.8 | −1.6 |
| 10 | −3.7 | −0.8 |
| 11 | −6.2 | 0.2 |
| 12 | −9.5 | −1.5 |
| 13 | −12.0 | −1.5 |
| 14 | −5.0 | 0.0 |
| 15 | −1.8 | 0.7 |
| 16 | −7.5 | −2.5 |
| 17 | −7.3 | −0.9 |
| 18 | −4.0 | −0.1 |
| 19 | −5.4 | −2.0 |
| EPEFE fleet prediction | −10.94 | −1.59 |
| Actual result from car tests | −17.44 | −4.50 |

The fuel of Example 6 was also compared to another fuel of the present invention, Example 8. Table 6 below shows the properties of these fuels.

TABLE 6

| | Example 6 | Example 8 |
|---|---|---|
| Sulfur (wppm) | 460 | 14 |
| Mono-aromatics (% wt) | 19.26 | 20.09 |
| Polynuclear aromatics (% wt) | 4.84 | 1.19 |
| Total aromatics (% wt) | 24.10 | 21.28 |
| Aromatics/PNAs | 5.0 | 17.9 |
| Density (kg/m$^3$) | 844.1 | 843.0 |
| Cetane No. | 55.8 | 56.8 |
| $T_{95}$ (° C.) | −337.0 | −336.9 |

The fuels were run in a single light-duty diesel vehicle with common rail fuel injection technology. Each fuel was tested 3 times, where a test constituted a cold-start legislated European type certification dive cycle (ECE+EUDC). The relative emissions levels achieved from Example 8 fuel tests (relative to Example 6) were evaluated and compared with established EPEFE and AutoOil predictions, as in the comparison between the fuels of Examples 7 and 6. The results, shown in Table 7 below, indicate that for average particulate matter and NOx emissions the reduction achieved for the fuel of Example 8 was unexpected as it was greater than that predicted for any of the 19 vehicles used in the EPEFE program, as well as being significantly lower than the EPEFE fleet average.

Table 7. EPEFE/AutoOil predictions and actual fleet measurements for Example 8 emissions relative to Example 6 emissions (%).

| EPEFE Vehicle | PM | NOx |
|---|---|---|
| 1 | −4.9 | 1.0 |
| 2 | −5.7 | 0.0 |
| 3 | | −0.1 |
| 4 | −2.5 | |
| 5 | −1.8 | −1.7 |
| 6 | | −2.6 |
| 7 | −2.9 | −2.1 |
| 8 | −3.1 | −0.7 |
| 9 | −0.5 | −2.0 |
| 10 | 2.3 | −4.5 |
| 11 | −1.8 | −2.5 |
| 12 | −6.3 | −1.1 |
| 13 | −8.7 | −2.0 |
| 14 | −1.7 | −1.5 |
| 15 | −0.9 | −0.8 |
| 16 | −7.1 | −4.3 |
| 17 | −6.1 | −1.9 |
| 18 | 0.8 | −1.2 |
| 19 | −0.8 | −3.5 |
| EPEFE fleet Prediction | −3.56 | −1.13 |
| Actual result of car tests | −20.51 | −7.96 |

What is claimed is:

1. A distillate fuel composition boiling in the range of about 190° C. to 400° C. with a T10 point greater than 205° C., a T25 point from 363 to 374° C., and having a sulfur level of less than about 100 wppm, a total aromatics content of about 25 to 35 wt. %, a polynuclear aromatics content of less than about 3 wt. %, and wherein the ratio of total aromatics to polynuclear aromatics is greater man about 11.

2. The distillate fuel composition of claim 1 wherein the sulfur level is less than about 50 wppm.

3. The distillate fuel composition of claim 2 wherein the level is less than about 10 wppm.

4. The distillate fuel composition of claim 1 wherein the polynuclear aromatics content is less than about 2 wt. %.

5. The distillate fuel composition of claim 4 wherein the polynuclear aromtics content is less than about 1 wt. %.

6. The distillate fuel composition of claim 4 wherein the sulfur level is less than about 50 wppm.

7. The distillate fuel composition of claim 6 wherein the sulfur level is less than about 10 wppm.

8. The distillate fuel composition of claim 5 wherein the sulfur level is less than about 50 wppm.

9. The distillate fuel composition of claim 8 wherein the sulfur level is less than about 10 wppm.

10. The distillate fuel composition of claim 1 wherein the ratio of total aromatics to polynuclear aromatics is greater than about 13.

11. The distillate fuel composition of claim 10 wherein the ratio of total aromatics to polynuclear aromatics is greater than about 15.

12. The distillate fuel composition of claim 10 wherein the sulfur level is less than about 50 wppm.

13. The distillate fuel composition of claim 12 wherein the sulfur level is less than about 10 wppm.

14. The distillate fuel composition of claim 11 wherein the sulfur level is less than about 50 wppm.

15. The distillate fuel composition of claim 14 wherein the sulfur level is less than about 10 wppm.

16. A distillate fuel composition boiling in the range of about 190° C. to 400° C. with a T10 point greater than 205° C., a T95 point from 363 to 374° C., and having a sulfur level of less than about 50 wppm, a total aromatics content of 25 to 35 wt. %, a polynuclear aromatics content of less than about 2 wt. %, and wherein the ratio of total aromatics to polynuclear aromatics is greater than about 13.

17. The distillate fuel composition of claim 16 wherein the sulfur level is less than about 10 wppm.

18. The distillate fuel composition of claim 16 wherein the polynuclear aromatics content is less than about 1.

19. The distillate fuel composition of claim 18 wherein the sulfur level is less than about 10 wppm.

20. The distillate fuel composition of claim 16 wherein the ratio of total aromatics to polynuclear aromatics is greater than about 15.

21. The distillate fuel composition of claim 20 wherein the sulfur level is less than about 10 wppm.

22. A method for abating particulate and Nox emissions in a compression ignition engine comprising providing to the engine a distillate fuel composition boiling in the range of about 190° C. to 400° C. with a T10 point greater than 205° C., a T95 point from 363 to 374° C., and having a sulfur level of less than about 100 wppm, a total aromatics content of about 25 to 35 wt. %, a polynuclear aromatics content of less than about 3 wt. %, and wherein the ratio of total aromatics to polynuclear aromatics is greater than about 11.

23. A fuel composition comprising a distillate boiling in the range of about 190° C. to 400° C. with a T10 point greater than 205° C., a T95 point from 363 to 374° C., and having a sulfur level of less than about 100 wppm, a total aromatics content of about 25 to 35 wt %, a polynuclear aromatics content of less than about 3 wt. %, and wherein the ratio of total aromatics to polynuclear aromatics is greater than about 11, to which is added at least one of (i) one or more lubricity aid, (ii) one or more viscosity modifier, (iii) one or more antioxidant, (iv) one or more cetane improver, (v) one or more dispersant, (vi) one or more cold flow improver, (vii) one or more metals deactivator, (viii) one or more corrosion inhibitor, (ix) one or more detergent, and (x) one or more distillate or upgraded distillate.

* * * * *